United States Patent [19]

Crookston et al.

[11] Patent Number: 4,617,436

[45] Date of Patent: Oct. 14, 1986

[54] ACTUATOR FOR AN ELECTRICAL CIRCUIT INTERRUPTER

[75] Inventors: Ronald W. Crookston, Trafford; Hayes O. Dakin, Jr., North Huntingdon, both of Pa.

[73] Assignee: Electric Power Research Institute, Inc., Palo Alto, Calif.

[21] Appl. No.: 664,989

[22] Filed: Oct. 26, 1984

[51] Int. Cl.[4] ..... H01H 33/28

[52] U.S. Cl. ..... 200/148 R; 200/82 B; 200/148 F

[58] Field of Search ..... 200/82 B, 148 R, 148 A, 200/148 F

[56] References Cited

U.S. PATENT DOCUMENTS

| | | | |
|---|---|---|---|
| 4,251,701 | 2/1981 | Meyer | 200/82 B |
| 4,348,565 | 9/1982 | Yeckley et al. | 200/148 R |
| 4,358,648 | 11/1982 | Crookston et al. | 200/148 R |

*Primary Examiner*—Robert S. Macon

*Attorney, Agent, or Firm*—Flehr, Hohbach, Test Albritton & Herbert

[57] ABSTRACT

An actuator for an electrical circuit interrupter utilizes a gas generating chemical charge which is carried in its own cylindrical operating chamber. These power units are stored in a magazine and are fed into an operating position by a transfer cylinder in the form of a rotary turret head having cylindrical cutouts for the power units. The operating position specifically is with a chamber juxtaposed opposite one of the two input ports of a duplex power cylinder which is connected to the operating linkages of the interrupter itself. After the power unit has operated to open the interrupter, it is ejected. The operating action is linked to a duplicate set of a storage magazine and transfer cylinder for the close direction so that while the interrupter is opening the duplicate close actuator portion is readied for instantaneous action. This provides for a fast reclosing duty cycle and multiple operations. Also, for high operating speeds and good reliability.

16 Claims, 14 Drawing Figures

ACTUATOR FOR AN ELECTRICAL CIRCUIT INTERRUPTER

This invention relates to an actuator for an electrical circuit interrupter and more particularly to an actuator of the type using chemical propellant charges as an energy source.

U.S. Pat. No. 4,251,701 in the name of Thomas N. Meyer discloses a circuit interrupter of the type using a power unit which is filled with a propellant gun powder, for example, to open and close an oil type circuit breaker. The propellant power units may be arranged to connect to a piston cylinder to both open and close the circuit breaker. Moreover, pairs of cartridges are arranged in rotatable cylinders where two cartridges may be successively positioned for firing.

In a Pat. No. 4,358,648 in the names of Ronald W. Crookston and Hayes O. Dakin, Jr., there is disclosed an automatic technique for ejection and reloading of solid propellant charges. In effect, what is done is to operate by the use of a magnetic clutch the ejector pump slide on a modified conventional sporting shotgun which has repetitive action.

Circuit interrupters of the foregoing type, in modern switching stations, may be required to operate many times and under totally automatic conditions without need of an operator intervention; for example, reloading propellant cartridges or repairing malfunctioning equipment.

The Meyer patent may not adequately fulfill the above requirements in some switching environments.

It is, therefore, an object of the present invention to provide an improved actuator for an electrical circuit interrupter.

In accordance with the above object, an actuator for an electrical circuit interrupter comprises a storage magazine for storing and supplying a plurality of gas generating power units, such units having an exit port controllably providing a high pressure gas flow therefrom. Means are provided for receiving the spent power units. A power cylinder derives mechanical energy for operating the circuit interrupter from the high pressure gas flow and has an input port. Transfer means, including a rotary turret head, receives the power units from the storage magazine and successively juxtaposes the exit ports of the loaded power units with the input port of the power cylinder in an operating position. The transfer means ejects the spent power unit into the receiving means.

Also, in accordance with the invention, the transfer means is actuated by indexable plate means which are mounted for rotation with the transfer means and are connected to the power cylinder and responsive only to a return stroke of the cylinder for actuating the transfer means for moving another power unit into an operating position.

Figure 1:
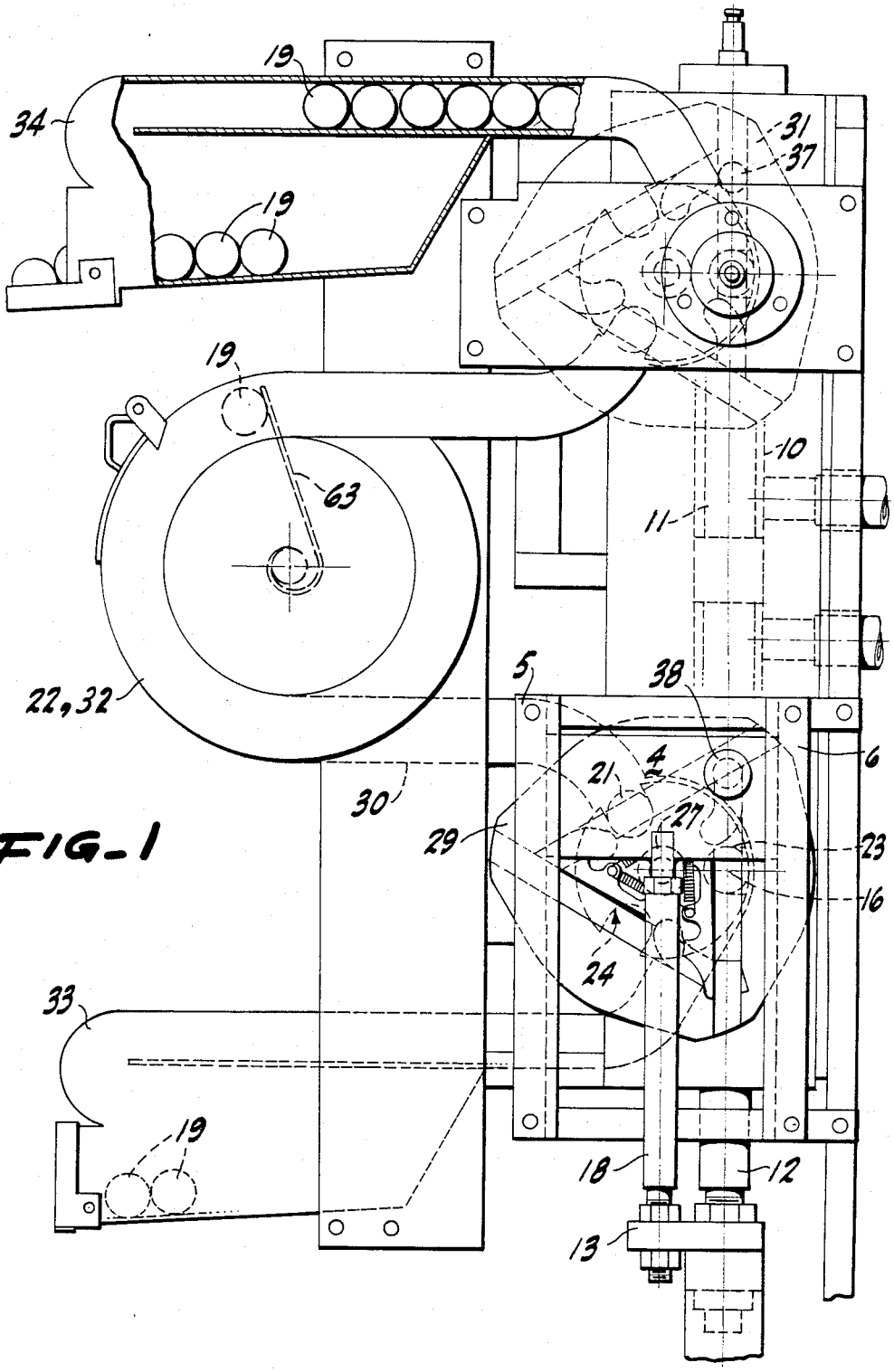
FIG. 1 is a simplified side elevational view of the overall actuator of the present invention.
Figure 2:
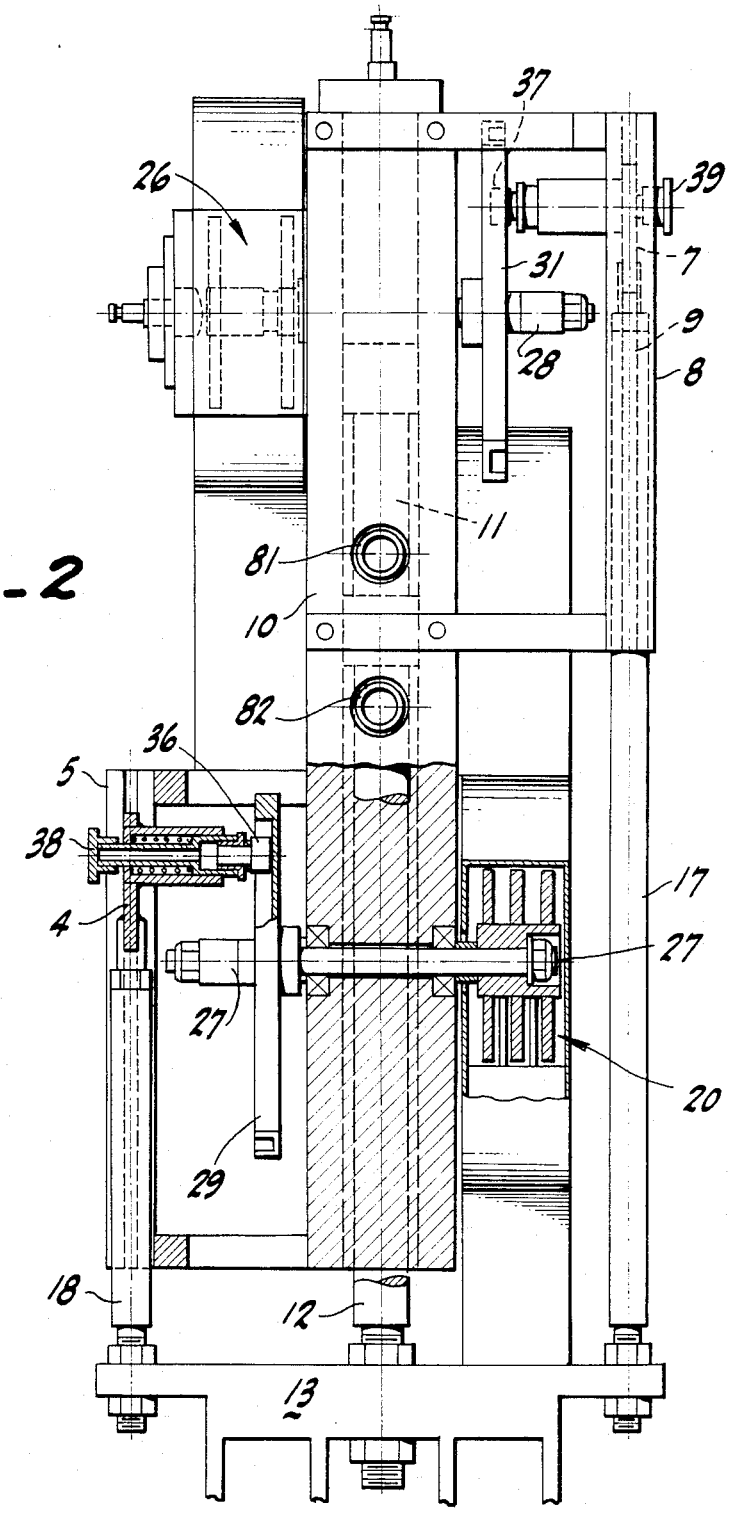
FIG. 2 is a front view of FIG. 1.

FIGS. 1 and 2 illustrate the overall basic mechanism of the actuator which includes a power cylinder 10 having a duplex piston 11 which via the piston rod 12 and the associated crossarm operating mechanism 13 is connected to an electrical circuit breaker. For example, it could be a circuit breaker, which is normally operated by a spring or pneumatic mechanism. However, in place of the pneumatic or spring mechanism, there is the chemical gas generating type mechanism of the present invention. Thus, the chemical mechanism might be connected to the breaker through the same connecting links, bell crank levers, etc.

As will be described in more detail below, the basic mode of operation is that the power cylinder 10 has an "open" input port centered at 14 (see FIG. 7) and a "close" input port centered at 16. These ports are alternately connected to a gas generating power unit. Initiation of the power unit associated with operating position 14 moves the piston rod downwardly to open the circuit breaker; and to close or reset the breaker, the power unit associated with the close port 16 is activated or operated.

The actuator of the present invention is a totally self-contained operational unit where the energy to propel the oscillatory drive mechanism comes directly from the operation of the power cylinder. More specifically, attached to the crossarm 13 at the end of piston rod 12, are, as best shown in FIG. 2, reciprocating drive rods 17 and 18.

Still referring both to FIGS. 1 and 2, the drive rods 17 and 18 are connected to, in effect, mirror image components or identical components which include a storage magazine for storing power units, a transfer means for receiving the power units from the storage magazine and putting them in the proper operating position, a spent power unit collector, and indexable plate means which actually couple the motion of the operating rods to the other components. Now specifically relating the rods 17 and 18 to these components, the rod 18 actuates an indexable plate 29 which is rotatable on an axis 27, via a reciprocable guide block 4 which is retained for vertical movement only by parallel and slotted guides 5 and 6. See FIG. 1. Similarly, the reciprocating operating rod 17 is coupled to an indexable rotary plate 31 which is mounted for rotation on an axis 28 via a guide block 7 slidable in parallel guides 8 and 9. They are linked to their respective indexable rotatable plates 29 and 31 by drive rollers 36 and 37 which are spring biased against the cam slots in the face of each of the plates. The biasing is accomplished by the respective plungers 38 and 39 which force the rollers into engagement with the respective cam slots of the plates. The plungers 38 and 39 are mounted in guide block 4 and 7 so that their axes of movement is offset from the axes of rotation 27 and 28 of the indexable plates 29 and 31. This offset motion is significant in providing for an effective rotation of the indexable plates as will be discussed below.

As best shown in FIG. 2, each indexable plate is connected to an associated transfer means by its axis of movement; viz plate 29 to transfer means 20 via axis 27 and plate 31 to transfer means 26 via axis 28.

Referring particularly to FIG. 1, with respect to the transfer means 20, its three positions are illustrated and consist of the position 21 where from the close reloader magazine 22 a power unit 19 is received via chute 30. Then position 23 is the operating position where the power unit is actuated since it is opposite port 16. Finally, before the position shown at 24, the third rotatable position of the index plate, the transfer means has ejected the power unit into the spent power unit collector 33 as indicated. All of this applies to the "open" as well as the "close" actuator. With respect to the "open" actuator, there is illustrated a portion 32 of the storage magazine (which is superimposed over the close reloader 22) and the spent power unit collector 34 with power units 19 being indicated.

Thus, to review the reloader operation sequence, in the opening operation of the circuit breaker, both the transfer cylinder 26 and the indexable plate 31 (FIG. 2) must remain stationary to allow the firing of the power unit and containment of the high pressure gas. However, during this stroke, the close reloader magazine 22, the indexable plate 29 and the transfer cylinder 20 are all actuated or rotated to move a new power unit into the operating position. Thus, this readies the system for repetitive breaker operation and at the very fast rates which may be necessary.

Figure 3:
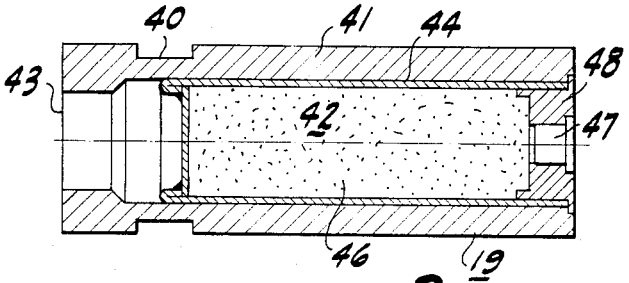
FIG. 3 is a cross-sectional view of the power unit used in the present invention.

FIG. 3 illustrates a typical power unit 19. The gas generating part of the unit may be a shotgun shell case 42 which includes a plastic or suitable exterior 44, the propellant 46 and an initiator 47 which is in the center of an end cap 48. A co-pending application in the name of Crookston et al, entitled ACTUATOR FOR ELECTRICAL CIRCUIT INTERRUPTER WITH NITROCELLULOSE TYPE SOLID PROPELLANT, Ser. No. 655,021, filed Oct. 26, 1984, discloses details of the optimum type of power unit.

Case 42 is fitted or slid into a metal cylindrical sleeve 41 which serves as the operating or pressure chamber for the power unit. Case 42 is slid into sleeve 41 in the same manner as a shotgun shell might be placed in the breech of a shotgun. Thus, the end 43 is the exit port of such pressure chamber; and this is what must be juxtaposed with the input ports of the power cylinder to provide a flow of high pressure gas from the power unit to initiate mechanical movement of the piston 11.

Groove 40 in sleeve 41 orients the power units in the magazine so they cannot be put in backwards.

The power unit construction, as illustrated in FIG. 3, is ideal since the sleeve 41 is reusable. Moreover, since it is also the firing chamber of the shell, it is a very efficient way of repetitively and rapidly moving a new power unit into an operating position.

Figure 4:
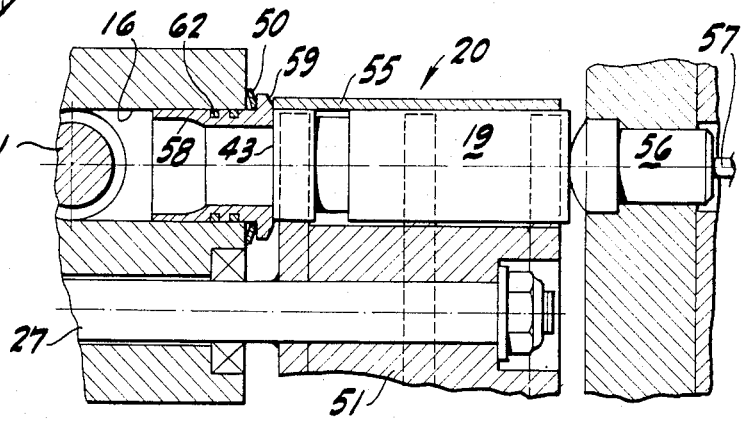
FIG. 4 is an enlarged cross-sectional view of a portion of the transfer means illustrated in FIG. 2.
Figure 6:
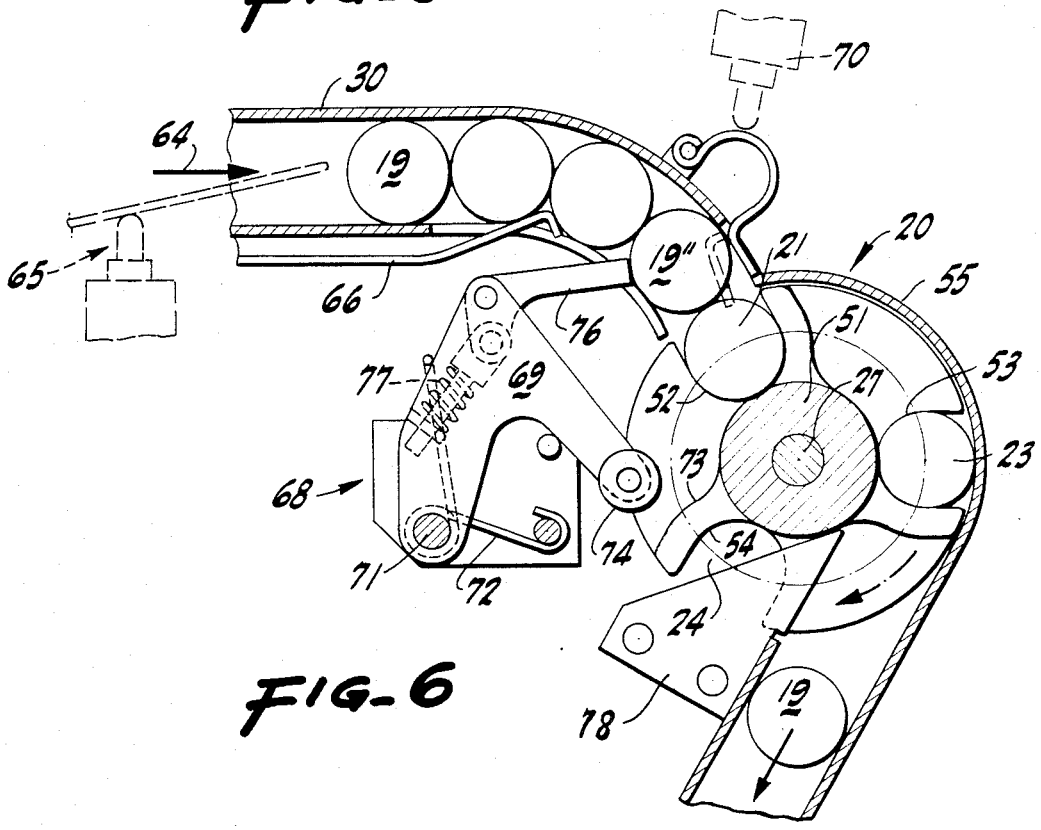
FIG. 6 is a cross-sectional view showing a typical operational mode of the transfer means of the present invention.

Now referring to FIG. 4, this is an enlarged view of a portion of the transfer cylinder 20 which illustrates the power unit 19 with its exit port 43 juxtaposed, in the operating position 23, with an input port 16 of the power cylinder 10. Transfer cylinder 20 is also shown in FIG. 6 where there is a better illustration of the rotary turret head 51 which includes three circular cutouts 52, 53 and 54 which retain the power units 19 in their receiving and operating positions and also provides an eject position. These three cutouts thus relate to the receive position 21, as illustrated in FIG. 1, the operating position 23 and the ejected position 24. A curved exterior shell 55 retains the power units during indexing and opens to the spent power unit collector 33 (FIG. 1).

Referring back to FIG. 4, in the operating position, the power unit 19 is juxtaposed with the percussive initiator unit 56. This is connected via control circuit wires 57 to a central control unit which would provide the signal to actuate the initiator and close the interrupter. Of course, the open operation is identical for transfer cylinder 26. Generally, initiation could be either percussive or electrical.

In the "close" gas input port 16, is a ring 58 which is slidable in the input port and has an annular surface 59 which is forced into sealing engagement with the exit port 43 of the power unit 19. This is done by a wave spring washer 50 installed around the sealing ring in the space between the outside surface of cylinder 10 and the backside of the annular surface 59. This provides a predetermined force greater than the frictional forces created by the high velocity gas flow from the exit port 43 of the power unit. Also the pressure tends to cause the seal to move against surface 43 to increase sealing effort. The ring 58 is also caused to expand radially by the pressure to seal. In addition, there are a plurality of grooves 62 serving as gas checks. This sealing structure and its method of operation is more fully explained in a co-pending application entitled DYNAMIC SEAL FOR GAS GENERATOR CHAMBER, Ser. No. 650,849, filed Sept. 17, 1984 in the name of Kiyoshi Norikane.

FIG. 6 illustrates the transfer cylinder 20 in greater operational detail. Specifically, it describes and demonstrates how the power units 19 are loaded into the transfer cylinder in a constant feed type mode from the close reloader magazine 22 via chute 30. Referring briefly to FIG. 1, this close reloader magazine includes a spring schematically indicated at 63 pressing against a loaded power unit 19 to force that unit against the remaining units in the track on chute 30 of a circular magazine so that a pressure towards the transfer cylinder 20 is provided. In FIG. 6, this is indicated by the arrow 64. Thus, as the power units are forced into the three circular cutouts 52, 53 and 54 of the transfer cylinder 51, this spring pressure 64 will force the power units over the spring retainer 66 which prevents backward motion of the power units.

A reliable and constant feed of the power units is provided, however, even though the magazine spring force 64 may not be present because of need for reloading of the magazine, by the follower or continuous feed mechanism 68. Such mechanism includes a lever assembly 69 which is pivoted for rotation at 71 and biased in a clockwise direction by the spring 72. The transfer cylinder 51 includes a three armed spider like cam surface 73 which is raised from the general surface with each arm of the spider sequentially pushing against a roller 74 mounted on the lever 69. On the rotation of the cam surface 73, this will push up against the roller 74 and rotate the lever 69 counterclockwise. As this occurs, a follower lever arm 76 will be moved upward, compressing a spring 77, and will come to rest behind the power unit 19'' as illustrated in FIG. 6. Thus, under the influence of spring 72, the power unit 19'' and the adjacent power unit already in the cutout 52 in the load position 21 are forced into the cutout 52 so that effective feeding of power units is ensured even though the spring load 64 is removed.

When there are only five, or some other preselected number of, power units left, alarm 65 is activated. This is merely a spring loaded feeler arm in track 30 located so that power units moving by it will normally maintain an associated switch open. But when only five units remain, the feeler arm is free to move closing the alarm switch. As a further precaution, a "cutout" switch 70 to prevent further operation when no power unit remains in position 21 is at load position 21.

In the final phase of operation of the transfer cylinder, after the power unit is activated, the rotation of the cutout 54 from position 23 to 24 passes an ejector cam 78 causing the ejection of the power unit as indicated into the spent power unit collector 33 (FIG. 1).

Figure 7:
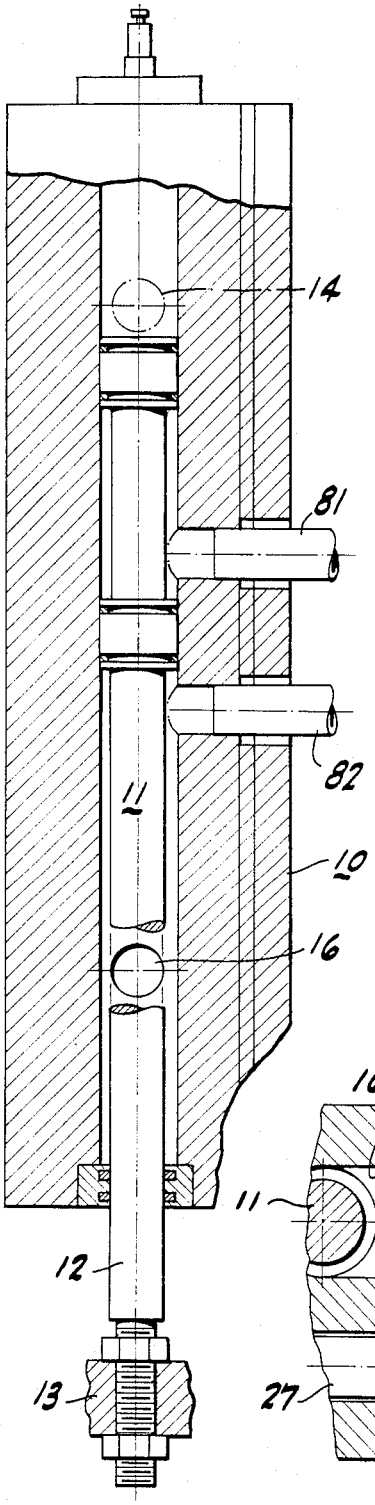
FIG. 7 is a cross-sectional view of the power cylinder of the present invention.

FIG. 7 shows details of the power cylinder 10 which includes a duplex piston 11 which is effectively two pistons separated by a spacer and in fact can be made up in this manner or as a one piece component. The piston rings are metallic such as cast iron or bronze and have overlapping ends to afford good sealing characteristics.

The "close" gas input 16 is illustrated which was discussed in conjunction with FIG. 4; and, of course, there is an "open" gas input 14. These are, as is apparent from examination of FIG. 2, on opposed sides of the cylinder 10 since transfer cylinders 20 and 26 are on opposite sides. Both the opening and close chamber portions have their own vents 81 and 82.

Figure 5:
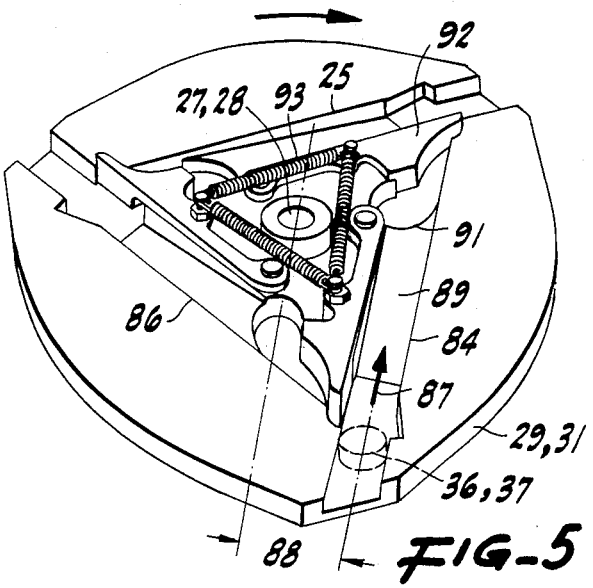
FIG. 5 is a perspective view of an indexable plate incorporating the present invention.

FIG. 5 illustrates indexable plates 29 or 31 which include three intersecting cam slots 84, 85 and 86. These three slots, of course, correspond to the three indexable positions of the plates which are 120° apart. Within these slots ride, as illustrated in FIG. 2, the rollers 36 or 37, which is indicated in its initial position by the dashed outline. In addition, the linear vertical movement of this roller is indicated by the arrow 87 controlled by, of course, the guide blocks 4 and 7 (FIG. 2); and the offset between the center of rotation 27,28 of the axis of the plates 29,31 and the vertical movement of the roller is also indicated by the offset indication 88 in FIG. 5.

Each cam slot includes a ramp 89 on which the rollers 36 or 37 ride up from the initial position ending in an abrupt step 91. This is best shown in the slot 86. Thus, the abrupt step 91 acts in effect as a latch which allows free movement of the guide roller in one direction but effectively latches it in the reverse direction opposite arrow 87 for rotating the index plate in a clockwise direction as will be discussed below. In other words, the ramp and step is a lost motion mechanism.

Finally, there are gate means for allowing the roller to transfer to the next slot but to prevent its return to the original slot. These are in the form of spring biased levers 92 biased by the springs in 93 as indicated. The gates with their cam slope also control the deceleration of the indexing plate.

Figure 8:
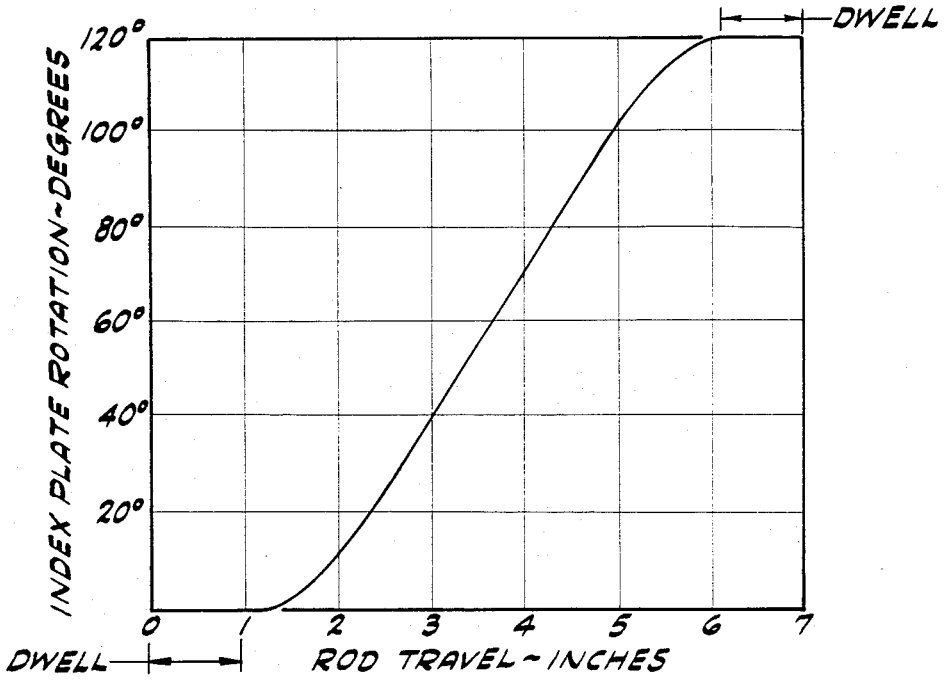
FIG. 8 is a graph useful in understanding the operation of the invention.

In operation, during the power stroke of the power unit of transfer cylinder 26, no rotation of the associated index plate 31 occurs. This is obviously necessary in order to maintain the power unit 19, which is supplying high pressure gas, in its operating position. Thus, the rollers 36 or 37 (whichever is the case) moves from its initial position up the ramp 89, is forced down the abrupt step 91 by its associated spring bias (from the plungers 38 or 39) and finishes its "lost" motion as will be described below. Now, when the associated guide block 4 or 7 is moved in the opposite direction and the roller starts from its initial position, the index plates 29 or 31 will be indexed one-third revolution in the clockwise direction. But during the initial part of the downward movement, there will be no motion of the index plate. In other words, there is a dwell period since the roller will move until it makes initial contact with the curved surface of abrupt step 91. Such dwell period is shown by the diagram of FIG. 8 and is indicated at the beginning of the drive rod travel where there is no rotational indexing of the plate designated by the vertical axis. In general, dwell periods are required or desired in this type of system at both ends of the mechanism stroke to avoid critical positioning of components and also for having a power unit in position to be ready for instant operation prior to the end of the previous power stroke.

Figure 9A:
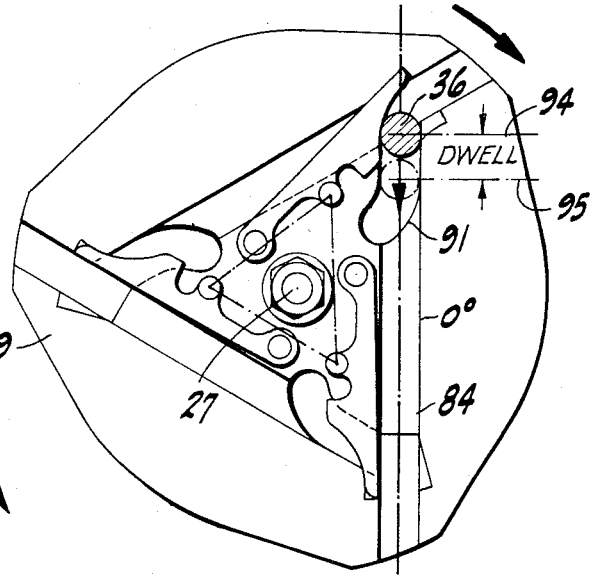
FIGS. 9A through 9F are fragmentary views of FIG. 5 in various operating positions.
Figure 9B:
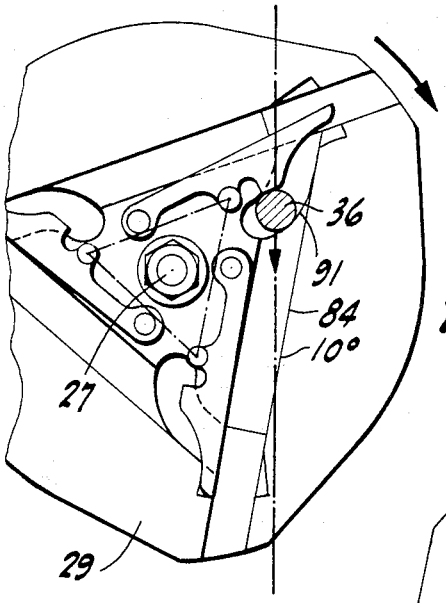
Figure 9C:
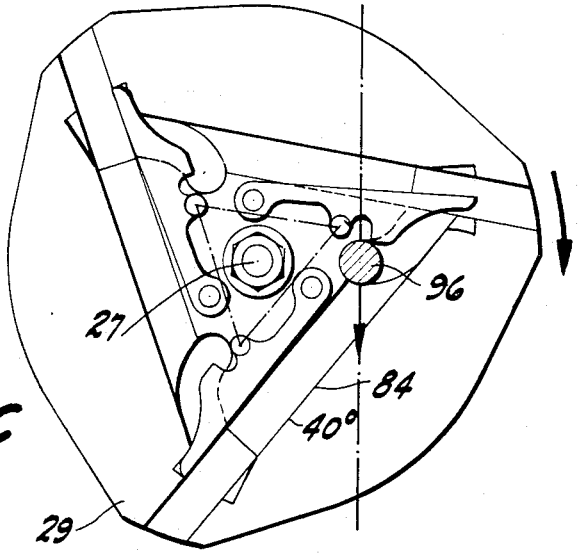
Figure 9D:
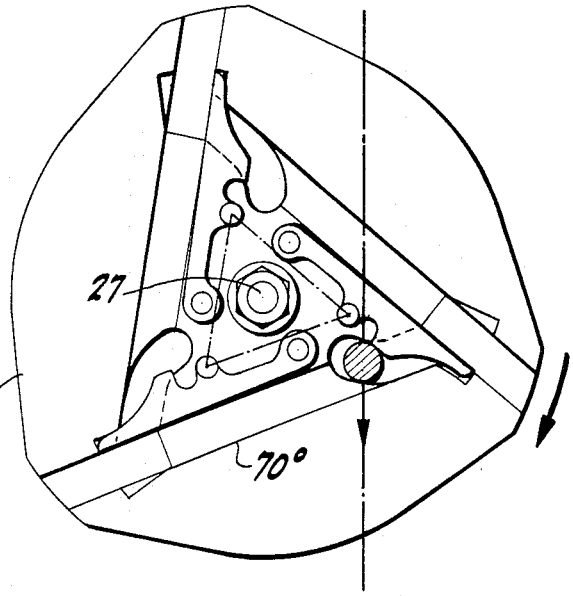
Figure 9E:
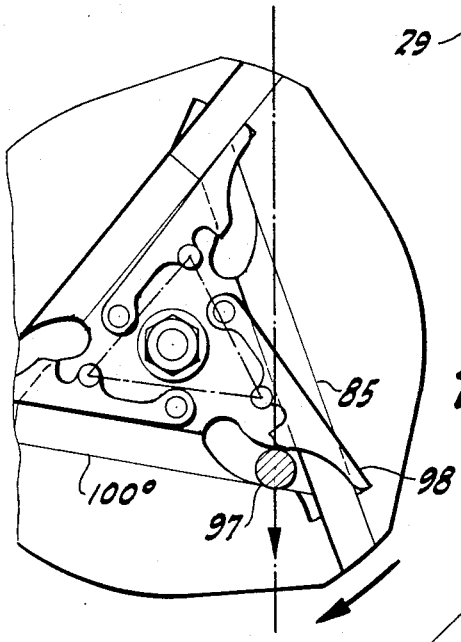

FIGS. 9A through 9F show the sequence of the movement of index plates 29 or 31 through 120°; the degree of movement is indicated on the slot 84. The linear or vertical motion of the roller is shown by the arrows. When the abrupt step 91 is initially engaged at 95 (FIG. 9A), the dwell period 94,95 has ended and the plate begins to rotate in a clockwise direction (FIG. 9B). When this rotation occurs, the roller moves against the curved surface of the abrupt step 91 to the extreme position 96 (FIG. 9C), then back out (FIG. 9D) of the slot along linear portion 97 (FIG. 9E) and moves the lever 92 into the recess 98 of the next slot 85. The rotation is effectively complete (FIG. 9F) when the roller is in the slot 85 and the lever 92 has returned under the force of spring 93 to the position shown in FIGS. 5 and 9F.

Figure 9F:
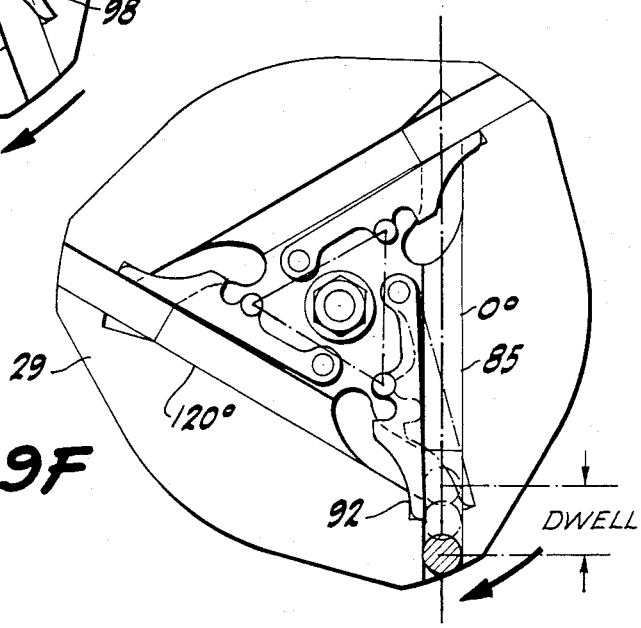

However, the roller 37 continues to move until it is in the lower part of slot 85 to thus provide the end dwell period shown in FIGS. 8 and 9F where the roller moves a substantial distance while the rotation of the indexing plate is stopped at 120°.

Another advantage of the above dwell period is it allows for tolerance variations in the end positions of the breaker stroke. Some circuit interrupters may not be operated for months or years at a time. Thus, for example, if the initial position of the rod is slightly erratic or the final position is somewhat short of its desired length of travel, this can be tolerated. Thus, the dwell function promotes the overall reliability of the actuator which is of utmost necessity in operating mechanisms such as this.

Thus, an improved mechanism that uses a chemical propellant for stored energy has been provided. It is one that works especially well with a sulphur hexafluoride puffer type circuit breaker where more energy and power is needed to open it because gas is being compressed at the same time as the mechanical opening takes place. The improved mechanism can also be used for oil or air circuit breakers. In addition, high operating speeds and multiple operations are made possible. Finally, a very reliable mechanism has been provided which does not need the constant attention of an operator.

What is claimed:

1. An actuator for an electrical circuit interrupter utilizing power units which when actuated generate a flow of high pressure gas for actuating the interrupter comprising:

a storage magazine for storing and supplying a plurality of said gas generating power units, each of such units having an exit port controllably providing said high pressure gas flow therefrom;

a power cylinder connected to said interrupter and having an input port responsive to said high pressure gas flow for actuating said interrupter;

transfer means including a rotatable turret head located in physical proximity to said input port of said power cylinder for receiving said power units supplied by said storage magazine, successively juxtaposing one at a time the exit ports of such received power units with said input port, and for ejecting such power units after being actuated to generate said flow of high pressure gas.

2. An actuator for an electrical circuit interrupter said interrupter having an open direction and a close direction comprising:

a storage magazine for storing and supplying a plurality of gas generating power units;

a power cylinder connected to said interrupter and responsive to high pressure gas flow from a said power unit while said power unit is in an operating position for actuating said circuit interrupter in one of said directions;

transfer means connected to said storage magazine and having a rotatable turret head for receiving said power units supplied by said storage magazine, successively moving such units one at a time to said operating position, and thereafter ejecting such units; and indexable plate means mounted for rotation with said turret head and connected to said power cylinder and responsive only to actuation of said interrupter in the other of said directions for rotating said turret head for moving another power unit into said operating position.

3. An actuator as in claim 2 including an additional storage magazine, transfer means and indexable plate means for providing said other direction of actuation where said power cylinder includes a duplex piston operable in said two directions to both open and close said circuit interrupter said additional plate means being indexable only when said interrupter is operating in said one direction.

4. An actuator as in claim 3 where each of said indexable plate means includes lost motion means for allowing movement of said power cylinder in a predetermined direction without indexing of such plate means.

5. An actuator as in claim 2 where said indexable plate means includes a plurality of intersecting cam slots in one face of said plate means, the number of said slots corresponding to the index positions of said plate means, and where said plate means is connected to said power cylinder by linear reciprocating means carrying a guide roller, said guide roller moving in a predetermined one of said slots.

6. An actuator as in claim 5 where the axis of movement of said guide roller is offset from the axis of rotation of said plate means.

7. An actuator as in claim 5 where said plate means includes latch means, associated with each of said slots for allowing free movement of said guide roller in one direction of said rod but latching in the other direction for indexing said plate means.

8. An actuator as in claim 5 where said plate means includes gate means for allowing said roller to transfer to the next slot but to prevent its return to the original slot.

9. An actuator as in claim 8 where said gate means acts as a decelerating cam for said plate means.

10. An actuator as in claim 7 where said latch means includes a ramp in said slots ending in an abrupt step and a roller which is spring biased against said ramp.

11. An actuator as in claim 8 where said gate means includes a spring mounted lever closing the end of each slot.

12. An actuator as in claim 10 where said plate means includes dwell means for preventing immediate rotation upon movement of said roller including means for spacing said roller from said step.

13. An actuator as in claim 11 where said plate means includes dwell means at the end of movement of said roller, when said plate means is being rotated, including an off-center mounting of the axis of movement of said rod from the axis of rotation of said plate means for moving said roller through said gate means into a new slot before completion of said reciprocating movement.

14. An actuator as in claims 1 or 2 where said power cylinder includes a reciprocating duplex piston with open and close portions coupled respectively to a pair of high pressure input ports and including open and close vents.

15. An actuator as in claim 1 where said power unit includes a gas generator case contained by a metal sleeve which serves as a pressure chamber.

16. An actuator as in claim 1 wherein said rotatable turret head of said transfer means includes a plurality of circular cutouts for retaining said power units in said receiving, operating and eject positions.

* * * * *